US007815048B2

(12) United States Patent
Bean

(10) Patent No.: US 7,815,048 B2
(45) Date of Patent: Oct. 19, 2010

(54) POKER CHIP CUP HOLDER

(76) Inventor: Jeffrey Bean, 517 Sixth St., Dover, NH (US) 03820

( * ) Notice: Subject to any disclaimer, the term of this patent is extended or adjusted under 35 U.S.C. 154(b) by 0 days.

(21) Appl. No.: 12/119,495

(22) Filed: May 13, 2008

(65) Prior Publication Data

US 2009/0283432 A1 Nov. 19, 2009

(51) Int. Cl.
*B65D 85/00* (2006.01)

(52) U.S. Cl. ..... 206/445; 206/217; 206/557; 206/564; 206/503; 206/509; 220/771; 273/148 R; D21/392; D21/394

(58) Field of Classification Search ..... 206/445, 206/217, 557, 562, 564, 503, 509; 220/771, 220/756, 758; 273/148 R, 148 A, 150; 211/49.1; 453/61; D21/392, 394; 248/213.2, 304, 248/311.2, 312.1, 313
See application file for complete search history.

(56) References Cited

U.S. PATENT DOCUMENTS

| | | | | | |
|---|---|---|---|---|---|
| 783,478 | A * | 2/1905 | Strauss | 211/58 |
| 1,097,799 | A * | 5/1914 | Godtfredsen | 211/49.1 |
| 1,900,798 | A * | 3/1933 | Chappell | 211/59.2 |
| 2,319,173 | A * | 5/1943 | Weiss | 131/235.1 |
| D146,731 | S * | 4/1947 | Vaccarello | D21/393 |
| 2,435,698 | A * | 2/1948 | Running | 211/49.1 |
| D158,063 | S * | 4/1950 | Gardenhire | D21/393 |
| 2,645,352 | A * | 7/1953 | Petzold | 211/49.1 |
| 3,034,517 | A * | 5/1962 | Reiland | 453/29 |
| D215,315 | S * | 9/1969 | Hall | D21/392 |
| 3,782,594 | A * | 1/1974 | Langieri et al. | 221/274 |
| 4,143,765 | A * | 3/1979 | Moss, III | 206/445 |
| D274,441 | S * | 6/1984 | Stevenson | D21/392 |
| 4,986,547 | A * | 1/1991 | Zarnoti | 273/241 |
| 5,219,419 | A * | 6/1993 | Prothe | 206/515 |
| 6,446,828 | B1 * | 9/2002 | Casteel | 220/575 |
| 2006/0141919 | A1 * | 6/2006 | Storinggaard | 453/61 |
| 2006/0157929 | A1 * | 7/2006 | Bianco et al. | 273/148 R |

* cited by examiner

*Primary Examiner*—David T Fidei
(74) *Attorney, Agent, or Firm*—Joseph E. Funk

(57) ABSTRACT

A gaming chip holder and cup holder in one integrally molded device. A generally cylindrical center cup holder section surrounded by semi cylindrical poker style chip holders placed about the circumference of the cup holder area. An area without the chip holders is replaced with an integrally molded handle to facilitate the transportation of the beverage and poker chips from table to table and about the casino in a controlled and organized manner. This handle is formed in such a way as to allow the chip and cup holder device to be slid under the typical poker table bumper pad as to further insure against spillage and to conserve space on the poker table. The chip and cup holder device is also stackable unto itself.

1 Claim, 4 Drawing Sheets

POKER CHIP CUP HOLDER

BACKGROUND OF THE INVENTION

While playing poker and other casino style card games it is important to use a cup holder when drinking beverages. Some casinos require use of a cup holder and even have them built into the tables themselves. Nothing can ruin a game faster then beverage spills on the table. Currently there are simple style cup holders that are used in most casino style card rooms that hold your beverage and slide under the padded bumper to ensure they can not turn over. In home games it is typically a larger problem as most hosts do not have any cup holders or professional style card tables.

This invention provides for a cup holder that also holds your gaming chips. This design also provides a handle similar to that of a coffee cup that can be used to transport your beverage and chips in a convenient manner. The benefits of this invention allow the user to keep their chips consolidated, organized and protected them from being tipped over. In addition they can be easily moved about the poker room as tables are consolidated as players bust out of tournaments. The central cup holder area keeps your beverage secure and in a consolidated fashion nested in the center of the players chips.

a) Tournament Game play requires you to move your chips during table consolidations using chip carriers so the current invention allows you to do so with your beverage and chips in one convenient and easy to handle package.

b) By combining your chip stacks and cup holder into one package you save valuable table space c) By providing a secure storage area for your chips during game play, the tipping over and subsequent falling off the table of the chips are eliminated.

d) The stackable nature of the invention also allows for the simple convenient storage and distribution of chip before, during and after game play.

SUMMARY OF THE INVENTION

The present invention is an integrally molded combination of features comprising the following:

A. The cup holder is the central feature of the invention and is round in design and is sized to fit most popular beverages. It is comprised of a cylindrical style opening with side walls that are tapered to facilitate the injection molding process. The wall thicknesses of the cup holder are sized to the most economical and structural combination allowed by the state of the art.

B. The Chip holders are integrally molded around the circumference of the cup holder portion in a radial fashion. The chips are stacked in a vertical manner held in a series of cylindrical tube like features. Each tube like feature is sized to hold the gaming chips with a minimum amount of clearance. The front portion of the tube feature radially away from the cup holder is cut away as to allow access to the chips by the user. This cut out area is sized to allow the chips to be retained in the carrier by the side walls but leaves the chips exposed to the user for easy manipulation, stacking and removal from the carrier. The current embodiment of the invention allows for 5 tubes around the cup holder but any number of tubes may be used.

C. The tube like chip carriers are placed radially around the cup holder and form a plane on the user side of the invention that allows the device to held tight against the gaming tables bumpers that are common place in casinos.

D. The area behind the bumper plane is used for the integrally molded handle feature and retention tabs. The handle extends toward the user and downwardly but does not extend to the base. The area under the handle is left open to allow the invention to be held tightly against the gaming bumper and not interfere with the bumper. The tabs on both sides of the handle are integrally molded features that are slid under the gaming bumpers. This feature allows the invention to be held securely in place during game play and still future reduces the possibility of spills.

E. The invention provides a feature for stacking itself together for compact storage of the chip carriers and gaming chips when not in use. The upper edge of the cup holder portion extends above the chip carrying tube features. This extension fits into a recess of similar size on the bottom of a second chip carrier.

DETAILED DESCRIPTION OF THE PREFERRED EMBODIMENT

Figure 1:
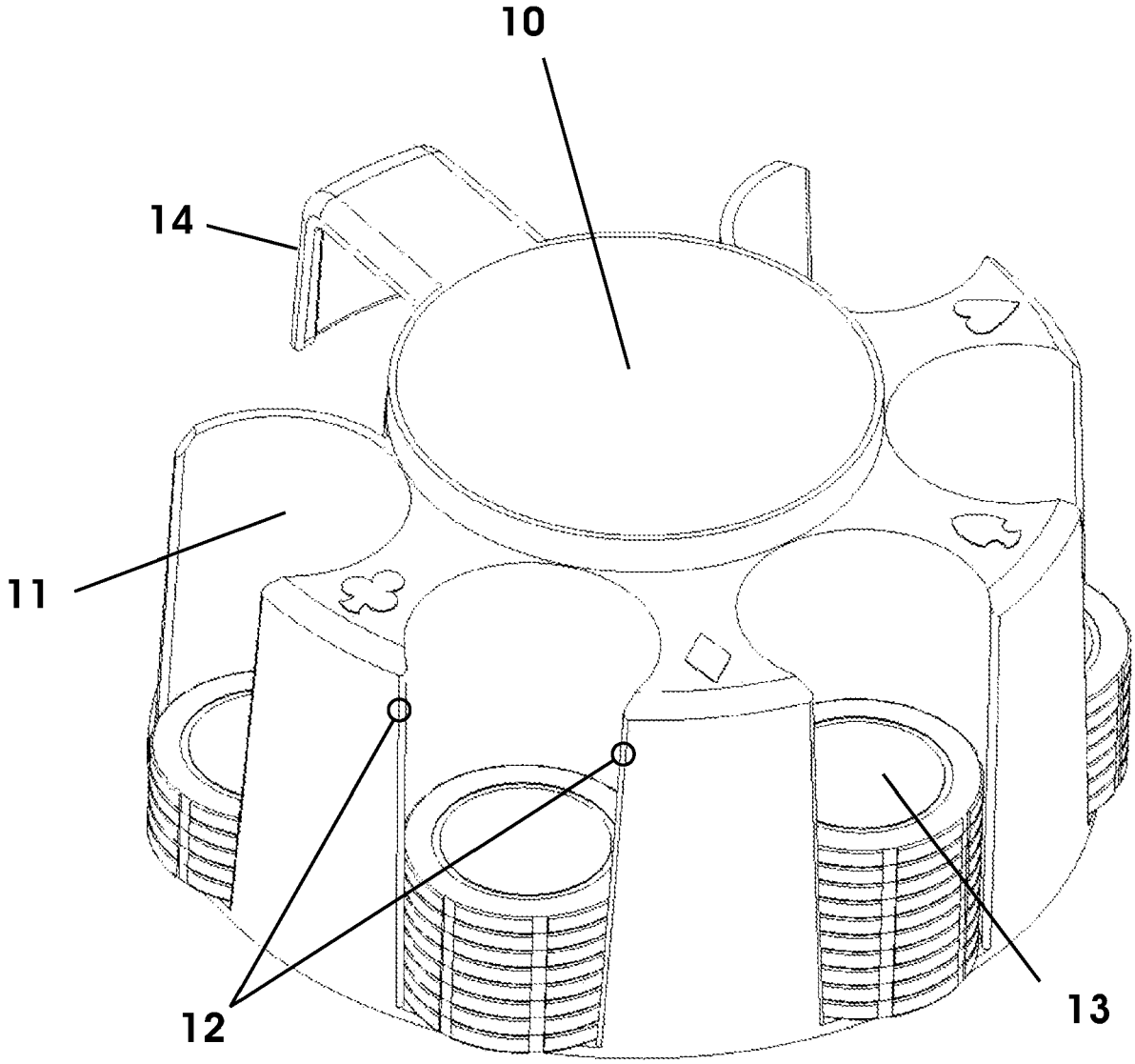
FIG. 1 is a an Isometric view of the Gaming Chip Cup Holder device

As seen in FIG. 1, the poker chip cup holder device is comprised of a central cup holder area 10 surrounded by the vertical chip holder chambers 11. The vertical chip holder chambers have an opening 12 that is used to retain the gaming chips 13 in place. Handle 14 projects from the top edge of cup holder 10. Handle 14 is used to transport the device during use.

Figure 2:
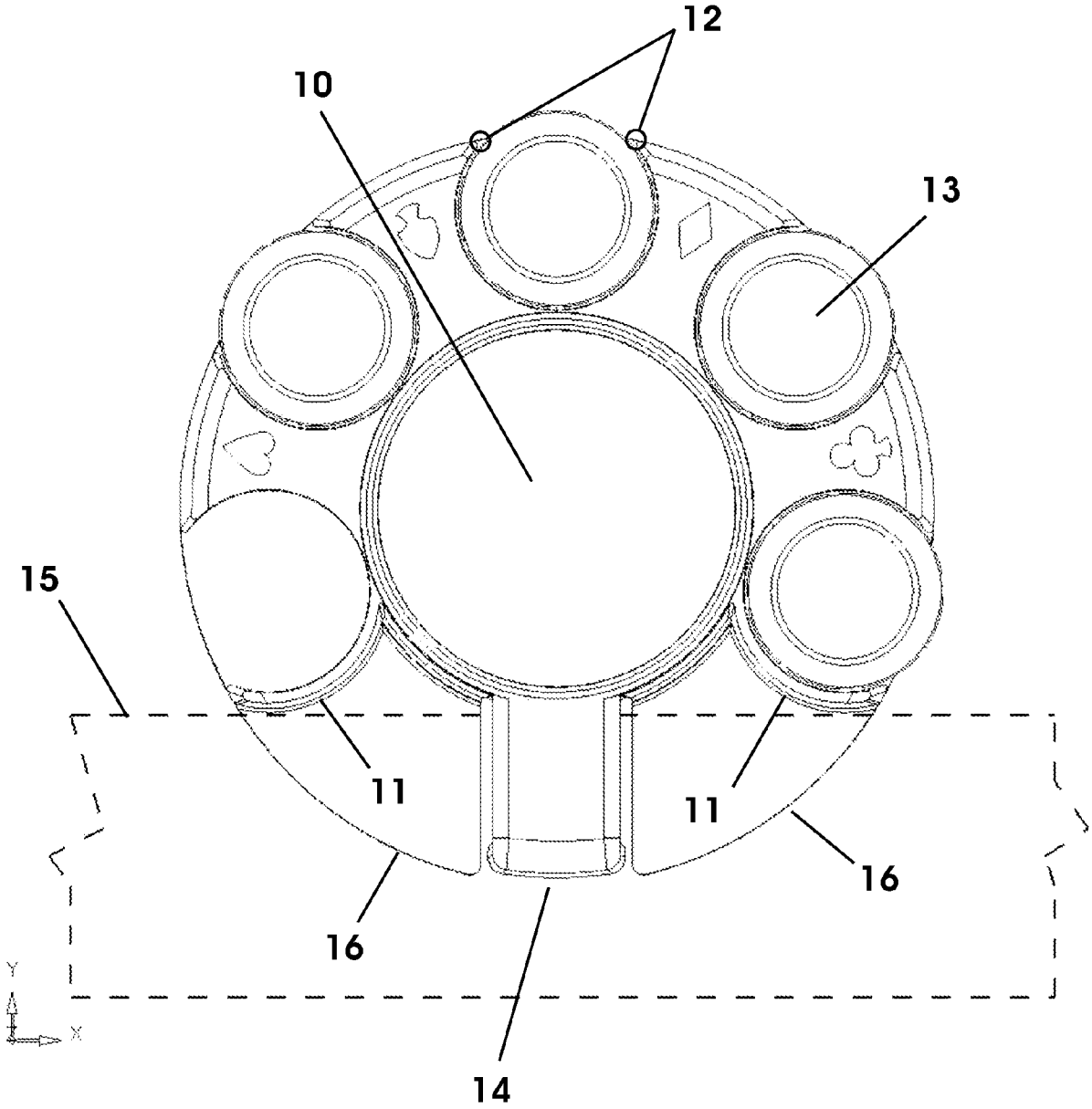
FIG. 2 is a top view of the of the Gaming Chip Cup Holder device.

FIG. 2 shows a simple top view of the device as it is used in conjunction with a typical gaming table bumper 15. The cup holder 10 is shown in position against the gaming bumper 15. On either side of cup holder 10 are the vertical chip holder chambers 11 that form a flat plane against the gaming table bumper 15. The remaining vertical chip holder chambers 11 are equally spaced about the front portion of cup holder 10. Tabs 16 are shown under the gaming table bumper 15. These retention tabs 16 are part of the preferred embodiment but are not required and may be removed on different versions of the device. As handle 14 projects downwardly it stops short of the base by a dimension governed by gaming table bumper 13. Opening 12 allows for access to the gaming chips 13 with the users fingers for easy storage and removal during game play. Opening 12 is sized to retain the chips securely and not allow them to come out with out the intentional actions of the user. Chips 16 can be stacked on top of each other until the vertical chamber is full.

Figure 3:
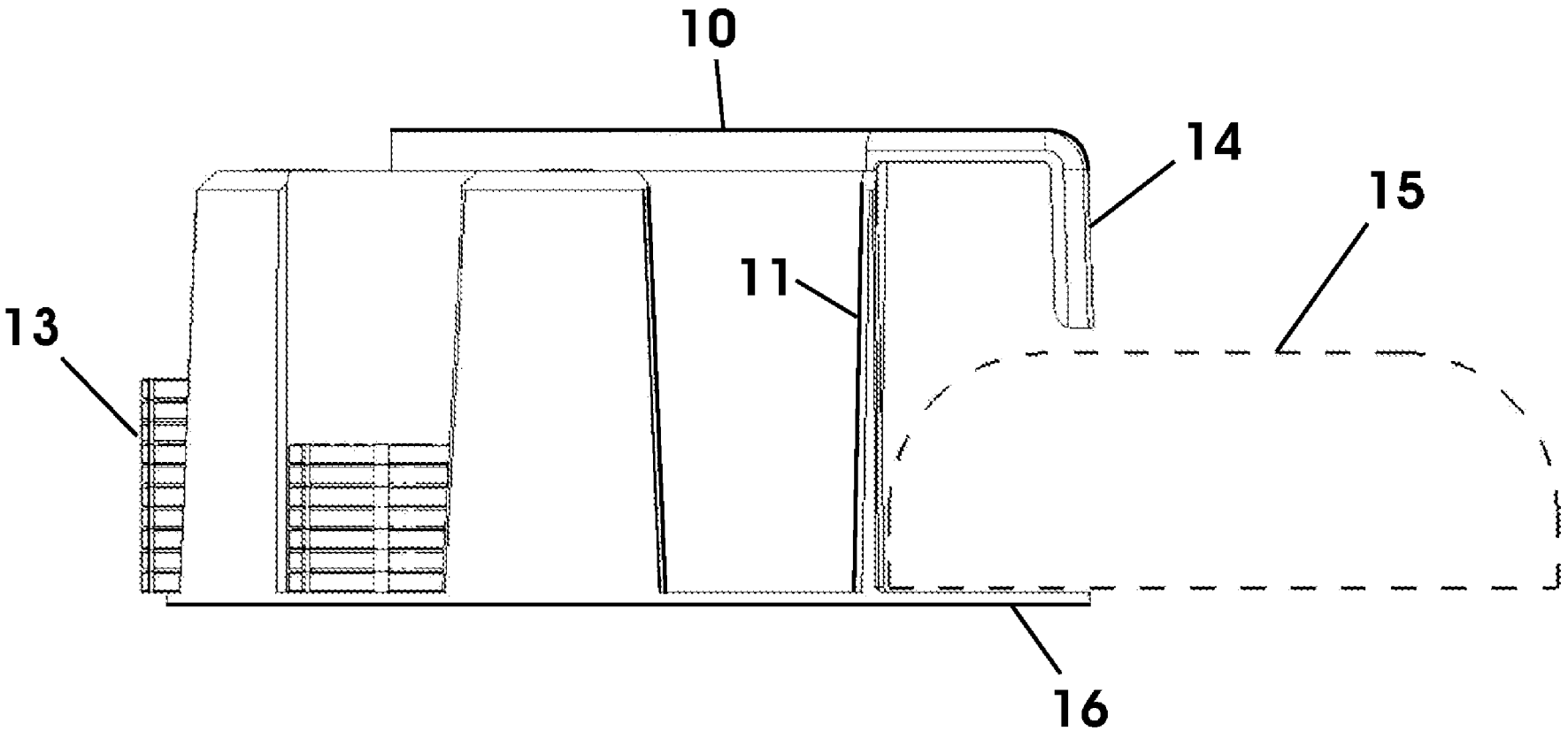
FIG. 3 is a side view of the Gaming Chip Cup Holder device.

FIG. 3 shows a simple side view of the device as it is used in conjunction with the gaming table bumper 13. The cup holder 10 and vertical chip holder chamber side wall 11 is shown in position against the gaming bumper 15. Handle 14 is shown projecting downwardly above the gaming table bumper 15. Tabs 16 are shown in position under the typical gaming table bumper 15. This feature is desire-able to more securely hold the cup holder device in place when used in conjunction with a gaming table bumper.

Figure 4:
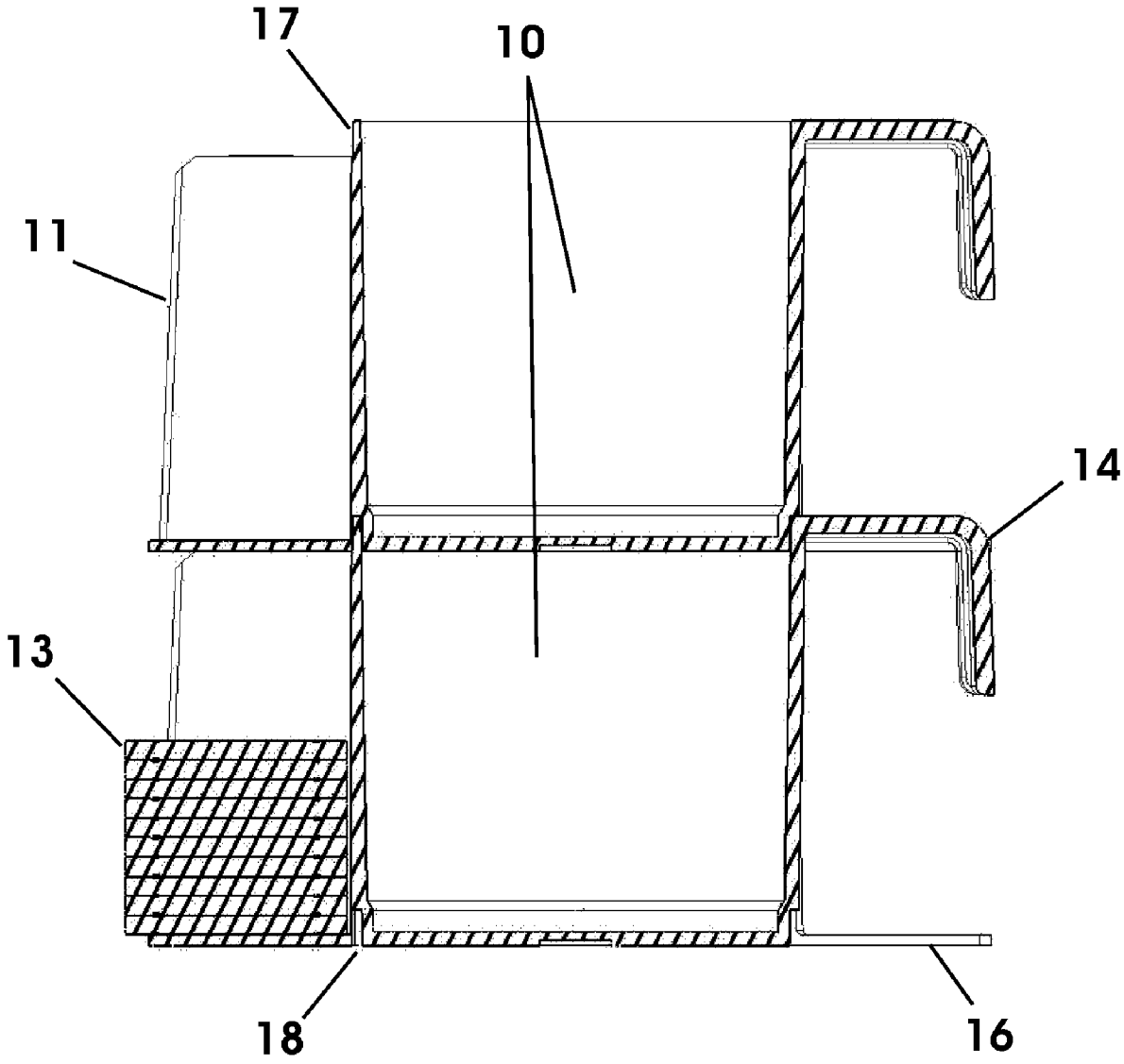
FIG. 4 is a side view of the stacked Gaming Chip Cup Holder device.

FIG. 4 shows a cross section of two cup holder devices stacked on top of one another. Lip 17 is shown as it nests into recess 18 on the bottom of the device.

I claim:

1. A poker chip and cup holder integrally molded as one piece and having a central cup holder with a base, the poker chip and cup holder being used on a poker table with side bumpers, wherein the poker chip and cup holder comprises:

a) a plurality of cylindrically shaped tubes surrounding the central cup holder where poker chips are stored;

b) wherein the cylindrically shaped tubes are generally vertically oriented and each tube has a front portion furthest from the central cup holder removed to allow for easy access to poker chips stored in each of the cylindrically shaped tubes, wherein the removed front portion of each cylindrically shaped tubes partially expose the chips stored therein yet still fully retain the chips in a secure manner until they are removed; and c) a handle molded to the side of the cup holder and extending outwardly and downwardly from the cup holder, the handle being used to carry the poker chip and cup holder, wherein the handle does not extend downwardly to the base of the cup holder to thereby allow the handle of the poker chip and cup holder to be positioned over poker table side bumpers;

d) a flat projection radiating outwardly from the base of the cup holder that is used to retain the poker chip and cup holder under the poker table side bumpers; and e) nesting means allowing for the stacking of poker chip and cup holders with one another.

* * * * *